US008289148B2

(12) United States Patent
Adams

(10) Patent No.: US 8,289,148 B2
(45) **Date of Patent: *Oct. 16, 2012**

(54) ACCESS ANNUNCIATOR

(76) Inventor: Albert G. Adams, Mississauga (CA)

( * ) Notice: Subject to any disclaimer, the term of this patent is extended or adjusted under 35 U.S.C. 154(b) by 274 days.

This patent is subject to a terminal disclaimer.

(21) Appl. No.: 11/486,095

(22) Filed: Jul. 14, 2006

(65) Prior Publication Data

US 2007/0018814 A1 Jan. 25, 2007

Related U.S. Application Data

(62) Division of application No. 10/902,098, filed on Jul. 30, 2004, now Pat. No. 7,081,826.

(60) Provisional application No. 60/490,957, filed on Jul. 30, 2003.

(51) Int. Cl.
*G08B 23/00* (2006.01)

(52) U.S. Cl. ..... 340/523; 340/541; 340/545.1; 340/546

(58) Field of Classification Search .... 340/545.1–545.9, 340/523, 528, 686.1, 569, 570, 568.7
See application file for complete search history.

(56) References Cited

U.S. PATENT DOCUMENTS 3,585,584 A * 6/1971 Behrend ..... 340/430
4,211,990 A 7/1980 Gwozdz
4,284,861 A 8/1981 Senften
4,422,068 A 12/1983 Halft et al.
4,427,975 A * 1/1984 Kinzie ..... 340/547
4,683,460 A * 7/1987 Nakatsugawa ..... 340/545.1
4,797,663 A 1/1989 Rios
4,833,449 A 5/1989 Gaffigan
5,144,283 A 9/1992 Arens et al.
5,570,079 A 10/1996 Dockery
5,705,982 A * 1/1998 Faltings ..... 340/541
7,307,524 B2 * 12/2007 Adams ..... 340/545.6
2004/0000996 A1 * 1/2004 Addy ..... 340/539.17

* cited by examiner

*Primary Examiner* — Jennifer Mehmood
*Assistant Examiner* — Hongmin Fan
(74) *Attorney, Agent, or Firm* — Gerald A. Gowan; Gowan Intellectual Property

(57) ABSTRACT

An electronic device that functions as an area-intrusion informing device for announcing the unauthorized entry into an enclosure or area which has at least one access opening and closing means. The device uses components that are small for inconspicuous insertions, or for surface mounting, and preferably utilizes a dummy hinge arrangement as an electrical conductor between the various components. The device is used for access doors, windows, filing cabinets, desk draws, closets, and the like, and typically includes at least one light emitting diode, an optional numeric liquid crystal display, a timer, and alert signaling and reset components. The components act together to provide notification of illegal entry between the times of departure, and arrival, of authorized users of the enclosure or area. A simple security alert system is provided.

9 Claims, 7 Drawing Sheets

Fig. 6
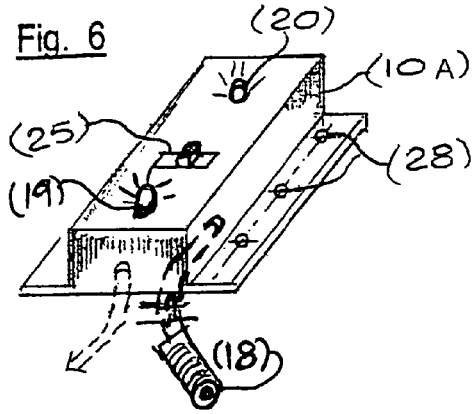
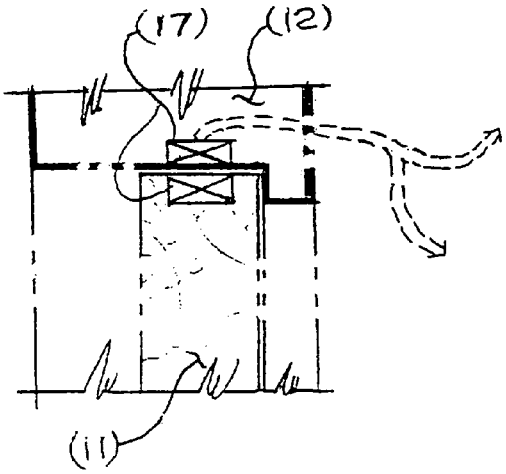
Fig. 5
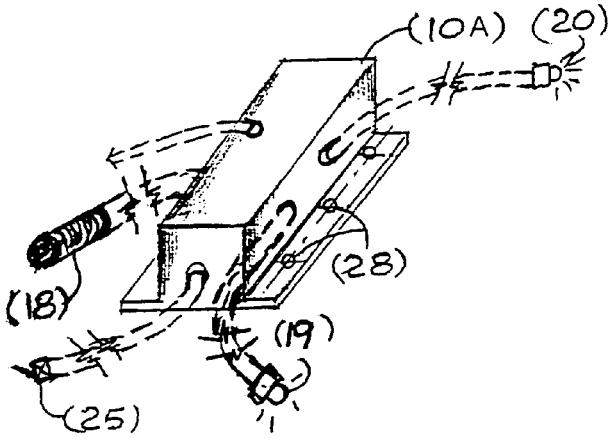
Fig. 4
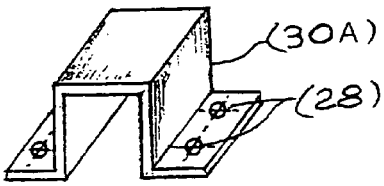
Fig. 7

BLOCK DIAGRAM FOR MOTION DETECTOR ALARM SYSTEM

BLOCK DIAGRAM FOR PASSIVE INFRARED SENSOR ALARM SYSTEM

BLOCK DIAGRAM FOR ACCESS ANNUNCIATOR

BLOCK DIAGRAM FOR OPTIONAL PORTABLE READER (40)

BLK. DIAG. - WIRELESS CNTRLER. OF PRINCIPAL UNIT

BLOCK DIAGRAM FOR OPTIONAL WIRELESS ACCESS ANNUNCIATOR

ACCESS ANNUNCIATOR

CROSS REFERENCE TO RELATED APPLICATIONS

This is a Divisional application of application Ser. No. 10/902,098 filed Jul. 30, 2004, now U.S. Pat. No. 7,081,826 which in turn claimed the benefit of priority under 35 U.S.C. §119(e) to U.S. Provisional Application Ser. No. 60/490,957, filed on Jul. 30, 2003. The entirety of both documents is incorporated herein by reference.

FIELD OF THE INVENTION

This invention relates to an alarm, or more simply, to an "alert" system, for notifying a user of unauthorized entry into a place or location. In particular, a simpler form of an alarm system is provided.

BACKGROUND OF THE INVENTION

Conventional alarm systems are well known in the art. Commonly, known burglar alarm systems commence their functional cycle as the occupant prepares to leave the protected area. The system displays the security status of each zoning area and if verified satisfactory, the system will then allow itself to be armed by means of an activating switch or equivalent, on its' control center, which sequentially energizes a timed delay for allowing the occupants to leave the protected area within a given short period of time. On leaving the protected area, the entrance/exit door is locked. The timed delay device then relinquishes control to the monitoring devices of the control center. The system's control center is now poised to energize several different remote devices, the number of which is dependent upon the quality and sophistication of the alarm system. If there is no violation, between departure and arrival of the occupants, its' alarm devices will remain deactivated. Provided the system is disarmed immediately on entering said protected zone, by entering a secret code, or any other form of security, the system is disarm. If however there is illegal access, the system goes into automatic defense mode by activating one or several alarm signaling devices. This can include, for example, notifying the appropriate organizations, and/or persons of the illegal entry, as well as activating audible, visual or other types of alarms which may be installed.

These devices however, comprise several additional different features than the devices of the present invention. As such, they are much larger devices which require surface mounting in conspicuous locations. This gives rise to the temptation of tampering and manipulative exploitation of the keypad coding system within its' control center.

Accordingly, while they have proven to be effective for their intended use, it would be desirable to provide an alerting device which would alert the user of unauthorized entry into a specific location. Also, it would be advantageous to provide a simple system for alerting a user of illegal entry by using a device which is inconspicuous in normal usage.

SUMMARY OF THE INVENTION

It is a principal advantage of the present invention to provide an alert system which is simpler in operation that currently known devices. It is again to be emphasized that the present invention does not serve to replace, or improve on the conventional alarm systems; and that it merely fills the need for a more simple, and less expensive means of illegal entry recordal or notification.

As such, the advantages set out hereinabove, as well as other objects and goals inherent thereto, are at least partially or fully provided by the access annunciator of the present invention, as set out herein below.

Accordingly, in one aspect, the present invention provides a device for informing on entry gained within any enclosure having an access opening, which device comprises a pulsed switching means, and an alert signaling means for generating an alert signal when activated by said pulsed switching means.

The pulsed switching means is merely any switch or device which can provided an on/off signal when engaged or contacted.

Accordingly, the present invention comprises principal components that, when installed, will function as a sealed tamper proof annunciating device, small enough for inconspicuous insertions, or surface mounting.

Further, the device provides the features of a substantial switching means, which will essentially energizing an alert device on its' sequential third attempt. Thereby said alert device remains in an energized state on all subsequent attempts, and does not change status until manually reset. This represents one complete functional cycle of said invention.

As such, in a further aspect, the present invention also provides a device as hereinabove described, wherein said device comprises a counter memory means for causing it to operationally count a specific number of events, having alert signaling means, and reset means.

For example, the access annunciator is preferably configured so as to trigger an alert the third time the system is activated. In a typical use, on system reset, the door within its' access opening will be closed or locked by authorized person prior to leaving the area for which intrusive information is required. On return of the user, being a second authorized entry, the status of the alert signal is inspected. If the access annunciator has not, or does not activate, this is a clear indication that no one else had opened said door. If however, said authorized person observes by inspection that said alert system is energized, for example by a flashing LED, or other designed alert signaling means, having a timed delay lasting some minutes on each event of opening said door, then this is a sure indication that the door was opened at least three times, inclusive of the previous, and present events. As such, the user is notified of entry by some other person.

Said alert component is preferably controlled by a timed delay component, which initializes on each event of opening said door, and energizes said alert component for a specified duration to conserve battery energy. This condition will persist until disarmed by an authorized individual. The Access Annunciator will be again initialized by its' reset means. This will commonly constitutes one complete functional cycle of said invention.

The present invention also provides, an access annunciator device comprising an access switch which provides an access signal when said access switch is activated, an activation counter which counts the number of access signals received, an alert system which determines that a pre-set number of access signals have been received and activates an alert signaling means to generate an alert signal.

BRIEF DESCRIPTION OF THE DRAWINGS

Embodiments of this invention will now be described by way of example only in association with the accompanying drawings in which:

FIG. 4 provides a perspective view of a "principal" body which has input and output conductors positioned for top, side, or end entry;

FIG. 5 provides a side view of another aforementioned momentary switching means;

FIG. 6 provides a perspective view of another "principal" unit similar to that shown in FIG. 4;

FIG. 7 shows a perspective view of a second mounting bracket;

DETAILED DESCRIPTION OF THE PREFERRED EMBODIMENTS

Figure 1:
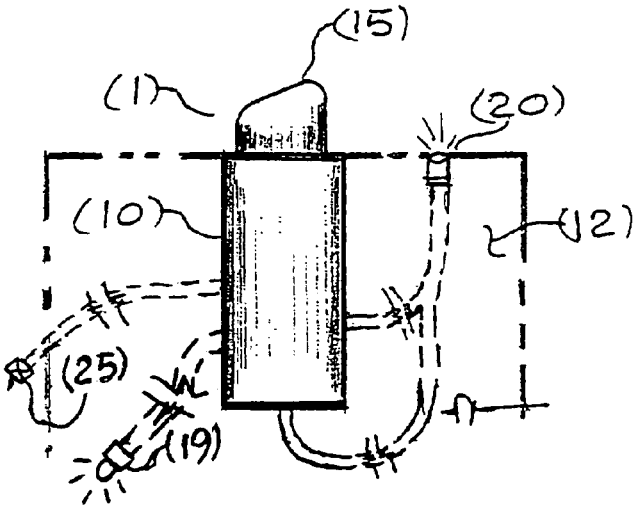
FIG. 1 illustrates a side view of one type of access Annunciator of the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

In FIG. 1, one type of an "insertion" Annunciator (1) is shown, comprising a momentary switching means (15), as well as various components and necessary semiconductors as may be found necessary, all of which are housed within or connected to, the same principal unit (10), and which are adapted to be installed within, for example, a door, or its' adjacent access opening. The device has an alert signaling component (in this case an LED (20)), and resetting switch (25) which is remotely located to that of principal unit (10). Inside of principal unit (10) is a battery for proper functioning of the unit, and an optional low battery LED indicator (19) is provided.

It is clear that an access annunciator device (1) according to the present invention is ideal for monitoring access doors, windows, filing cabinets, desk draws, closets, briefcases, suitcases, and the like, wherein it is desirable to monitor access to or from an enclosure or specific area.

Figure 2:
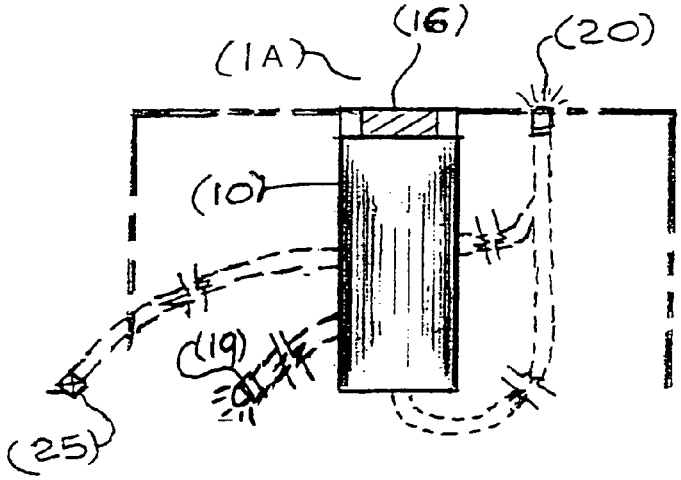
FIG. 2 provides a side view of a similar type of access Annunciator.

In FIG. 2 a similar insertion type Annunciator (1A) is shown which comprises a second type of said momentary switching means (16), inclusive of the components, and necessary semiconductors as may be found necessary, which are housed with principal unit (10). Again this unit (10) may be installed within either door (11), or its' adjacent access opening (12), having alert signaling component (20), a low battery indicator (19), and resetting switch (25), remotely located to that of their principal unit (10).

Figure 3:
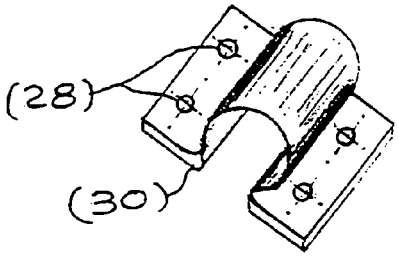
FIG. 3 provides a perspective view of a bracket for of a component of the access Annunciator.

The principal unit (10) can be inserted into a hole within a door, or a door frame, for example, or might be attached to a nearby surface using, for example a bracket (30), as shown in FIG. 3.

In FIG. 4, a different shape of principal unit (10A) is shown which is located remotely of the switching means. Again, however, the principal unit has input and output conductors positioned on its top, end and side panels.

In FIG. 5, a momentary switching means (17) is shown which is located remotely to that of principal unit (10A). Switching means (17) is connected to principal unit (10A) using a suitable connection means, including, for example, wires, or by wireless communication methods. Again switching means (17) is adapted to be located remote of its' principal unit (10A), and can be inserted into a door or door frame, as shown, or might be surface mounted on door (11) or its' adjacent access opening (12).

FIG. 6 shows a further principal unit (10A) having its principal components (inclusive of alert signal (20), and resetting means (25)) etc., housed within container (10A), and having a momentary switching means (17) remotely located to that of principal unit (10A).

FIG. 7 shows a retaining bracket (30A) having a different cross sectional configuration for surface mounting said principal unit (10A) to a desired surface.

Figure 8:
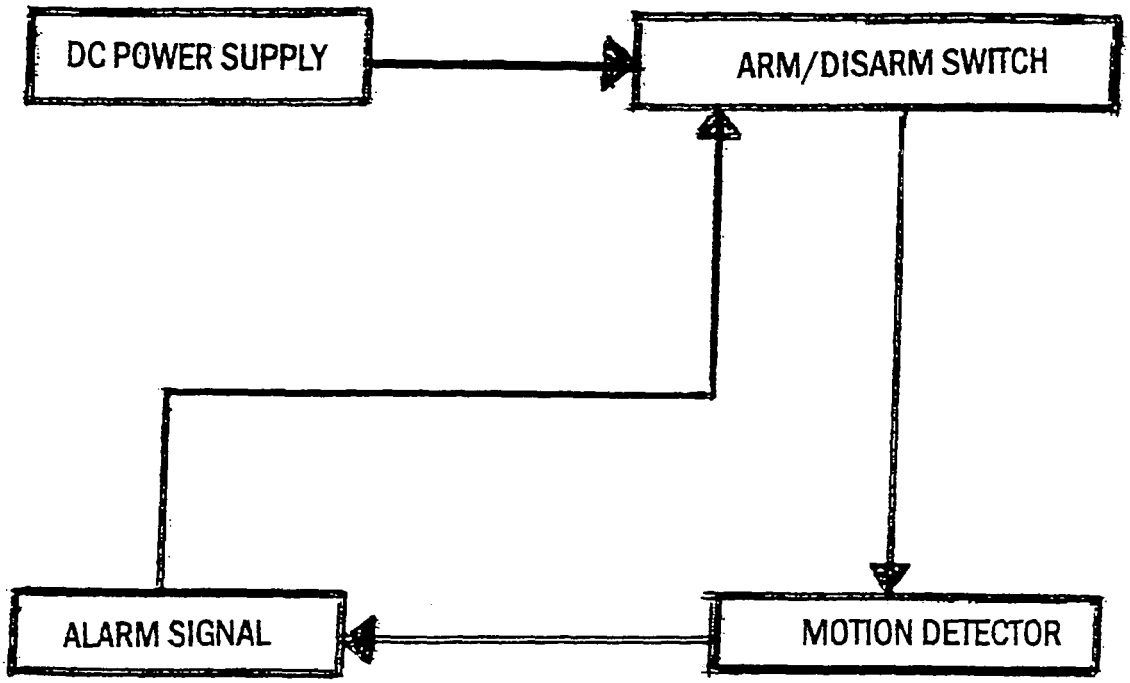
(PRIOR ART) Fig. 8
FIG. 8 is a block diagram of the motion sensor alarm system, in accordance with the prior art.

FIG. 8 is a block diagram of the motion sensor alarm system, according to the prior art. Its operation can be described as follows:

Personal Portable Alarm—Motion Sensor Type

The alarm system shown in FIG. 8 is a prior art personal, portable intrusion Alarm device, whose primary function is accomplished by means of Motion Sensor, comprising a DC power supply, having a single pole single throw activation switch, a motion sensor, and an audible alarm, all housed in one container, and having a hanging strap, whereby the system is hung around the door knob/handle located on the internal surface of the door within the protected area. The door is locked from the inside, and the alarm is activated by activating the switch. The system is now in a monitoring mode whereby it is poised to detect any movement caused by turning the door handle from the outside, as well as movement of the door as sensed by the alarm system, at which time its' alarm signal will be energized (usually an audible alarm), and whose alarm mode is also deactivated by turning off said switch. If there is no intrusion, the system may also be disarmed by deactivating the on/off switch. This system is small, light weight, and ideal for travelers staying overnight in hotels or at guest houses. It allows free movement within the protected area by its' occupants when armed. However, it is prone to false alarms by other guests inadvertently rotating the door handle on the outside of its' protected area. Due to its' close proximity to the intended intruders' hand, it can also be easily, and quickly disarmed by an intruder if the intruder gains instant access by using a key.

Figure 9:
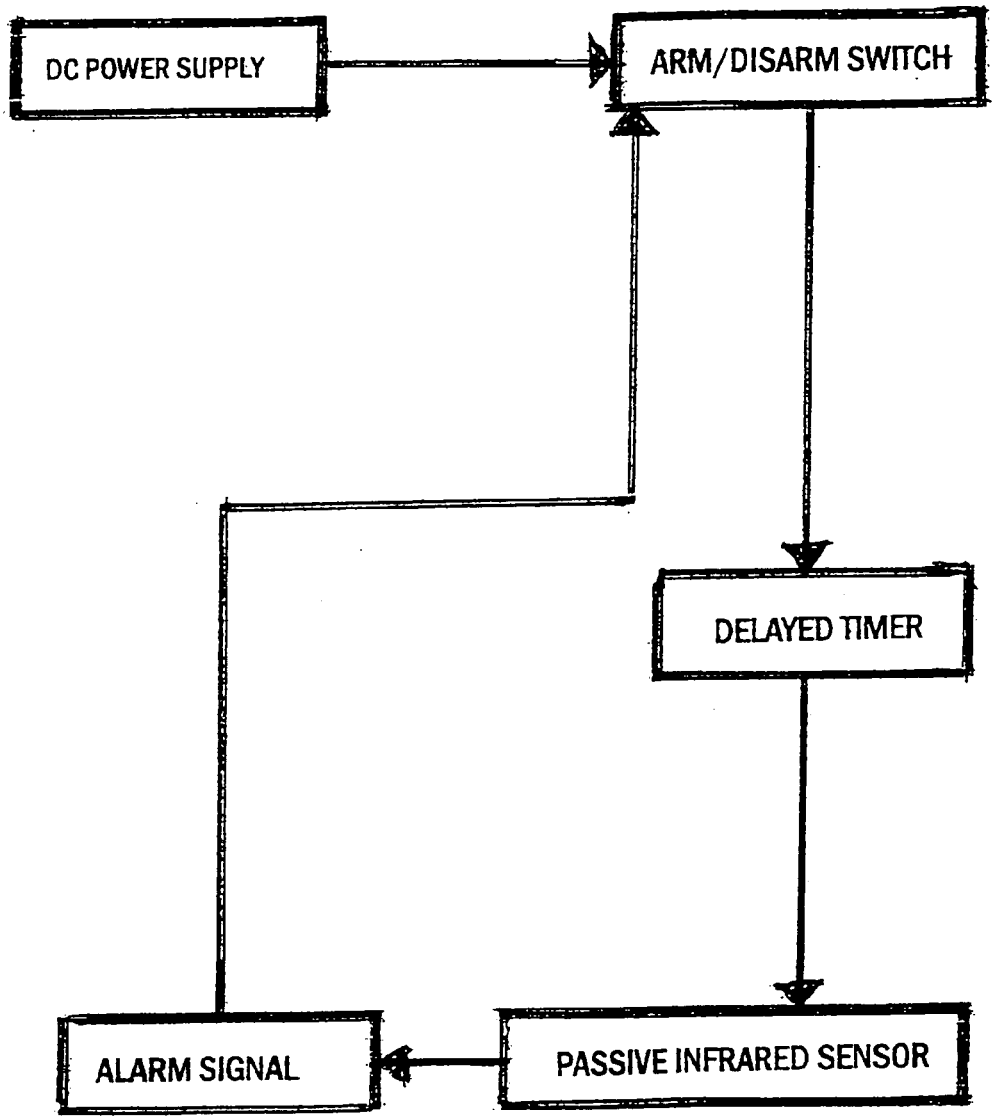
(PRIOR ART) Fig. 9
FIG. 9 is a block diagram of a second type of prior art alarm systems.

FIG. 9 is a block diagram of still another type of prior art alarm system, namely that of the passive Infrared variety. Its operation can be described as follows:

Personal Portable Alarm—Passive Infrared Sensor Type

The prior art alarm system shown in FIG. 9 is a system comprising a DC power supply, a single pole double throw activation switch, a timed delay, an infrared sensing component, and an alarm signaling device (usually audible), all housed in one container. This device is ideal for travelers as it is light weight and small. It is quite effective in protecting a designated area when its sweep is well adjusted. It can be placed in inconspicuous places, and aimed so as to avoid detect the movement of the occupants within the protected area, and thus avoid false alarms. Inconspicuously locating the device will also prevent an intruder from finding it quickly in order to disarm it before alerting the occupants of his/her presence. Some of these alarm systems also feature a panic alarm switch, in the event of an aggressive attack. A disadvantage is that it restricts movement of its' occupants within its' protected area when armed. To activate, the system is mounted in a well chosen, inconspicuous location where its' detection "sweep" is directed towards an area where an intruder must walk. It is then activated by a switch. A timed delay is then energized thus allowing the occupant to move out of range, lie down on a bed to sleep, or the like. While armed, if the alarm senses movement within the path of its' sweep, its' alarm is then energized. On awaking, the occupant may disarm it by switching it in the off position.

Figure 10:
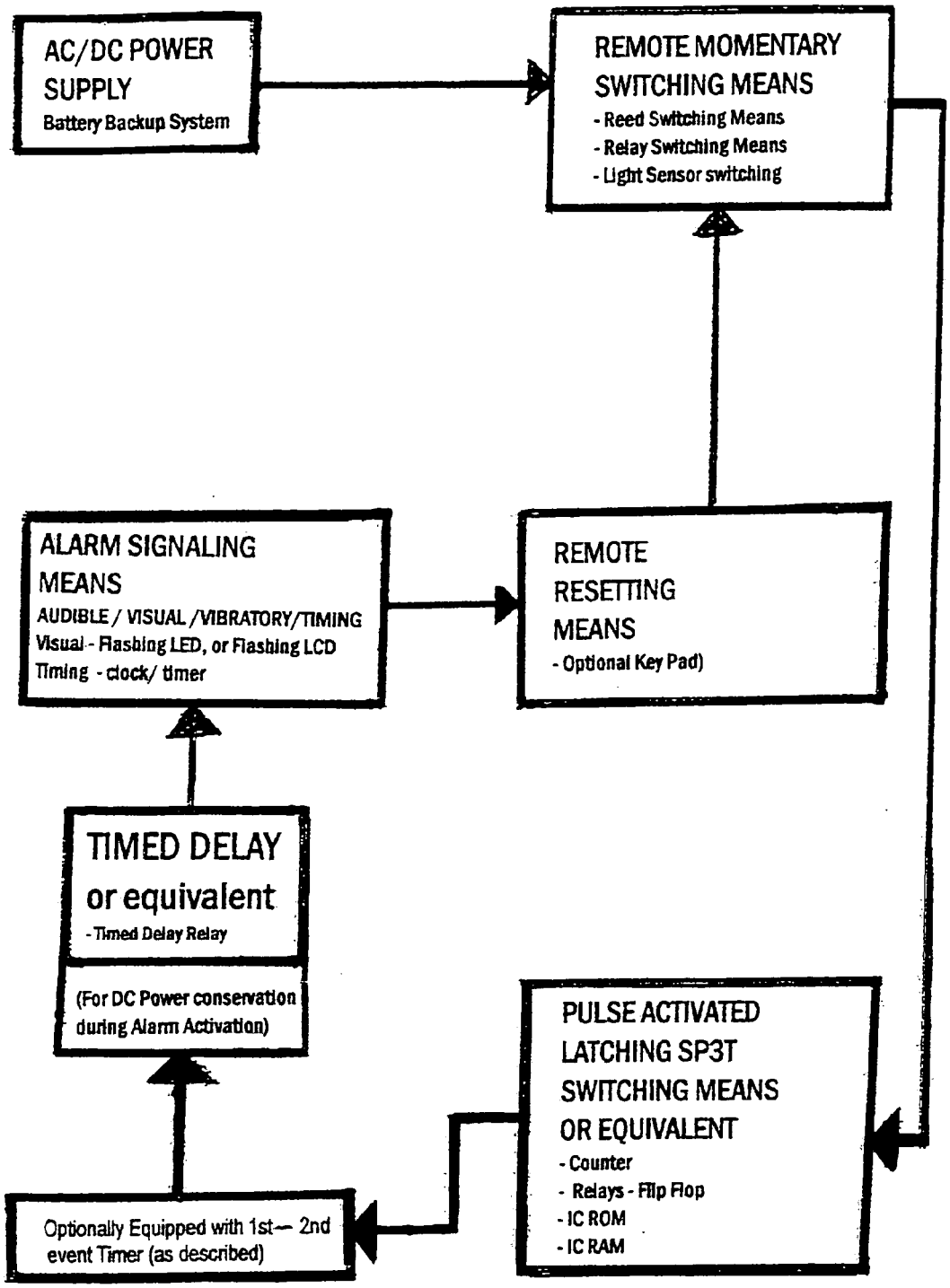
FIG. 10 is a block diagram of one embodiment of the device of the present invention.

While these devices have been used, the present system provides a simpler, and more convenient method to provide an indication of an intruder's entry, as described hereinabove. More specifically, the alert system of the present invention is better able to inconspicuously record an intruder's activities. FIG. 10 provides a schematic block diagram of the present inventive idea, and specifically that of the access annunciator.

The Inventive device as described herein, an example of which is schematically illustrated and referenced in FIG. 10, preferably comprises a power supply, having an optional built-in battery, a remote backup battery and AC/DC power supply, a momentary switching means ((15), (16), or (17), as shown in FIGS. 1, 2, & 5 respectively), a pulse activated single pole triple throw or equivalent switching means, an alert signaling means (20), and an initializing/resetting means. These are some of the principal components of the invention.

However, the skilled artisan will be aware of the use of other suitable components for the purpose of, for example, increasing, or decreasing current flows within the principal circuit. This might include semiconductors, and transformers, in order to facilitate the functional performance of aforementioned principal components if so required.

The aforementioned principal components of the present inventive embodiment will be packaged and housed in any combination for ease of functional efficiency including those examples shown in FIGS. 1, 2, 4, and 6, but not exclusively. This is done in order to facilitate the configurative layout of the particular location wherein said inventive embodiment will perform. In one example, the aforementioned power supply means, and said pulse switching means maybe locationally, and adjacently housed within the same container comprising said single pole triple throw or equivalent means, inclusive of aforementioned alert signaling means.

Having aforementioned resetting means locationally remotely housed, thereby yielding two separate parts comprising said inventive embodiment in its entirety. This constitutes one of several different combinations comprising aforementioned principal components herein described.

The invention preferably comprises an AC-DC power supply, interconnected to a switching means, and preferably a pulse switching means, whereby said pulse switching means interacts electronically via electrical conductor, or wireless means, to a device comprising a single pole triple throw switching means or equivalent. The preferred single pole triple throw switching means may include latching relays, counter, flip flop, IC ROM (non volatile memory chip), or IC RAM chip (volatile memory), or equivalent electronic devices.

The pulse switching means is preferably of the momentary switching variety, and preferably has a conventional construction. Suitable for use as a momentary access switches are contact switches, reed switches, relay switches, light sensor switches or the like. The switching means "triggers" on each and every event of, for example, opening a closed door or lid affixed to virtually any access opening. The pulse switching means may also be a light sensitive device, or a device which is stepped upon by foot, laser beam activated, a passive infrared sensor or an equivalent pulsed switching means. This includes any device which is capable of closing a circuit via an electrical conductor, or via a wireless means, whereby aforementioned single pole triple throw, or equivalent switching means is energized. The device may be of conventional construction.

The single pole triple throw or equivalent switching means electronically connects to an alert signaling means wherein the alert signaling means preferably comprises a timed delay relay, or equivalent for DC power conservation when either an audio, visual, vibratory or a combination of said alert components are activated. Said alert signaling means may optionally comprise a timer device having a Liquid Crystal Display (LCD) for indicating, for example, the time lapse between the first and second activated pulse events, and more specifically, the duration between the first and second entry. The Access annunciator in its' entirety will function as an Electronic Informing Device to be implemented within virtually any enclosure having at least one access opening with a closing means. The emphasis of this embodiment in its' entirety is preferably focused on the implementation of its' functionality as opposed to that of the varied configuration of its' containers, specifically that wherein said principal unit (10) is housed. It is ideal for access doors, and windows, filing cabinets, desk drawers, closets, and other portable enclosures as suitcases, briefcases, lunch pails and the like. The electrical logic of this embodiment will also prove functionally applicable as an enhancing feature within said existing door, lid and hood ajar alarm electrical circuitry of low end automobile installations, and displayed as a visual flashing alarm upon their instrumentation cluster panel. Also, the device is suitable for similar applications with heavy duty industrial field equipment.

The most preferable circuit layout of said principal components may either be linear, or digital (C variety), comprising power supply units of measurement of electrical operating pressure expressed in DC voltage ranging from substantially Nano volts to substantially 50 VDC, or more. The operating current flow within the aforementioned electronic circuitry of the principal unit (10) will preferably have units of measurements ranging from micro Amperes (μA) to Amperes (Amps). The aforementioned electrical units of measurements herein mentioned are indicative of specific environmental applications of said embodiment in its' entirety, in accordance with varied desired values chosen from within said ranges that are required to facilitate the desired electronic design of said Principal circuitry to satisfy the functional uniqueness of each installation environment.

A resetting means (25) will also be provided whereby the completion of each functional cycle of said inventive embodiment will be initialized in order to allow for subsequent functional cyclical repeats as per FIGS. 1, 2, 4 and 6.

Figure 11:
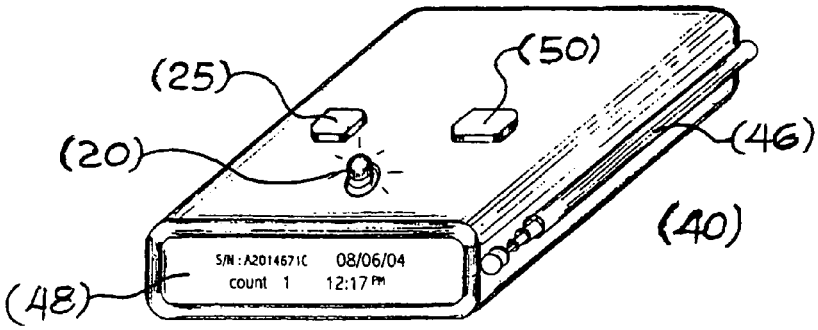
FIG. 11 is a perspective view of an optional hand held portable Device Reader.

In FIG. 11, an optional hand held portable Device Reader (40) is shown. The optional hand held portable device reader (40) preferably functions within the media of designated Radio Frequencies, and is preferably operational only when brought in substantially close proximity to the aforementioned principal unit (10). A preferred activation radius would range from about 2000 feet for a higher power supply, to a radius of about 20 feet or less for a lower power supply. However, this range can vary depending on the design of the unit. The hand held portable reader (40) comprise at least one light emitting diode (LED) (20) a simple means of visual alert display, and/or audio, or vibratory equivalents.

A further function of said portable reader (40) is the provision of a Liquid Crystal Display (LCD) (48), so equipped to provide for greater detailed information wherein the date and times of each entry, initial and subsequent access to closed enclosure, including those occurring between initial and final Resets will be displayed. A low battery indicator LED, or optional display equivalent (19) may also be included. Said portable reader (40) may comprise an internal or external antenna (46) means whereby communication with said principal unit (10) having corresponding internal or external antenna is enabled.

The purpose of said portable device reader (40) includes:

1. Avoiding physical contact with said Access Annunciator's Principal Unit (10) so as to maintain the integrity of its' locational concealment;
2. Facilitating resetting of said Principal Unit (10) by means of a reset button (25) within said Reader (40); and
3. Facilitating the ease of retrieving access data by means of a switch (50) for cycling through the displayed information.

Preferably, the system can also provide for the optional inclusion of a unit identification system comprising alphanumeric characters, bar code or equivalent, which can be either physically displayed on an external surface of said principal unit (10), and/or integrally assigned values within said electronic circuitry. These values can be displayed on display (48) of aforementioned remote reader (40), as an identification constant unique to each of the principal units (10) for the purpose of ensuring originality of equipment. This aids to ensure that the integrity of information retrieved is confirmed.

Figure 12:
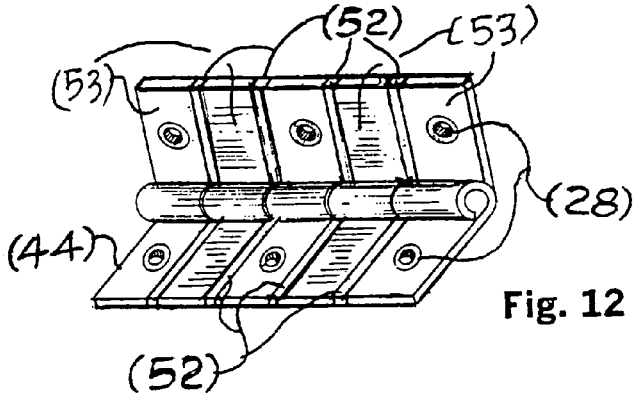
FIG. 12 is a perspective view of a hinge conductor for use in the practice of the present invention.

A device for use in a preferred embodiment of the present invention is shown in FIG. 12, which shows an electrical hinge conductor (44) which can be used for remote hard wiring of the device. The provision of an access opening with this dummy hinge conductor (44), whose primary function is that of a positive and negative electrical conductor comprising insulating divider (52) having electrical conducting means (53), is intended for the purpose of conducting an electrical signal from a momentary switch, such as (15), (16), (17) of FIGS. 1, 2, and 5 respectively, to the Principal Unit (10) when any of said switches is remotely located to that of said Principal Unit (10). Also, the dummy hinge conductor (44) can be used to transfer signals to the aforementioned resetting means (25) and/or said LED (20); —these latter devices being inconspicuously located and concealed remotely at a substantial distance from said access opening.

Figure 13:
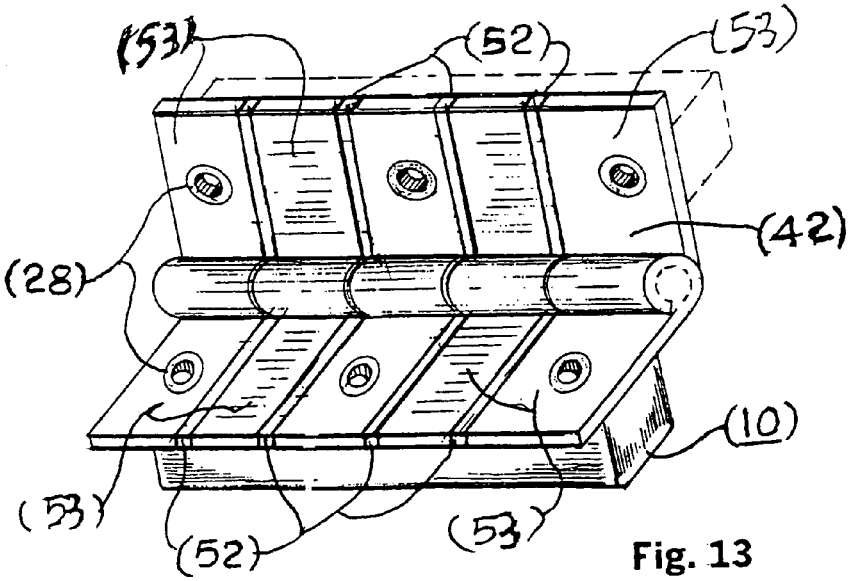
FIG. 13 is a perspective view of a hinge switch similar to the conductor of FIG. 12 being used in combination with a principal unit.

In FIG. 13, a modified version of this hinge is shown which acts as an electronic momentary switching hinge (42) which has Principal Unit (10A) attached thereto. Dummy Hinge Momentary Access Switch (42), might have principal unit (10A) optionally affixed to either or both its' leaves for concealment within aforementioned access door and/or adjacent jamb to which said embodiment is secured. The dummy hinge momentary access switch (42) comprises aforementioned insulating divider (52), having electrical conducting means (53), as described hereinabove. The dummy hinge switch (42) may function solely as a momentary switch whereby the principal unit (10) may be inconspicuously located and concealed remotely at a substantial distance from said dummy hinge access switch (42) and said access opening to which said access switch is secured.

Some preferred functional systems, wherein this embodiment will perform, include:

a) Basic function comprising principal unit (10) which is fully hand wired, having said access switch (15), (16), (17) of FIGS. 1, 2 and 5 respectively, housed within same container as said principal unit (10) OR remote to it, wherein electrical energy will flow by means of said dummy hinge conductor as per FIG. 12 (44), between said access opening and closing means, and aforementioned reset (25) and alert devices (20) that are remotely located, and may be inclusive of aforementioned low battery OED (19) indicator. An optional female jack (18) internally located to within Principal Unit (10), or remote to said unit (10), as per FIGS. 1, 2, 4 and 6, may also be provided for use with a battery recharging device of conventional construction. Said embodiment in its' entirety will comprise at least one LED (20), or other said audio, vibratory alert indicator as per FIGS. 1, 2, 4 and 6, having also resetting means.

b) As per (a) above less built in alert device, having aforementioned hand held portable device reader (40), with or without LED display (48), alternatively having at least one LED (20), or equivalent alert device and resetting means (25), comprising localized low battery indicator LED, or icon on an optional display.

Figure 14:
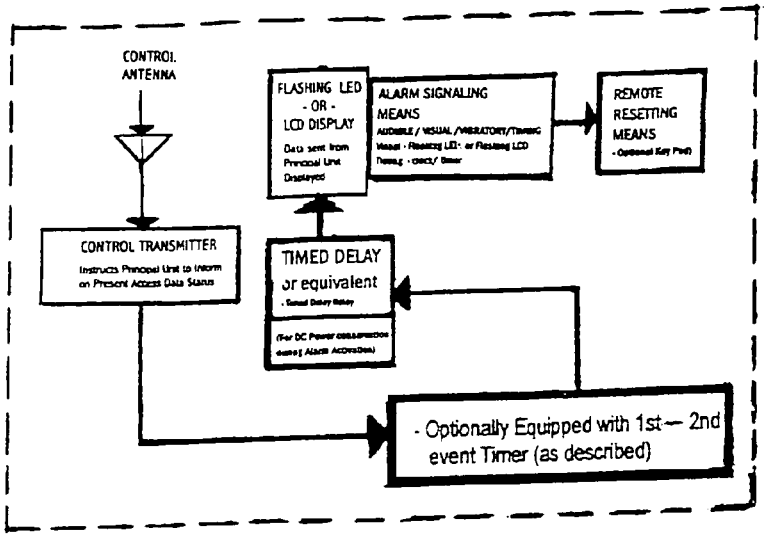
FIG. 14 is a block diagram of a hand held portable Device Reader.
Figure 15:
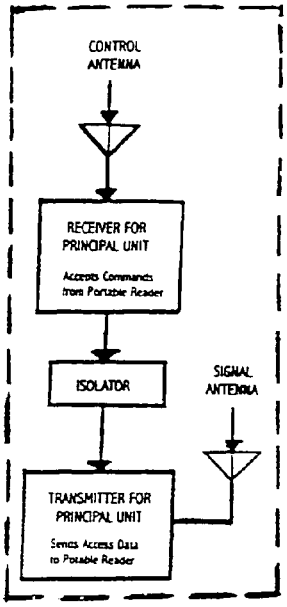
FIG. 15 is a block diagram of a Wireless Controller for use with the principal unit.
Figure 16:
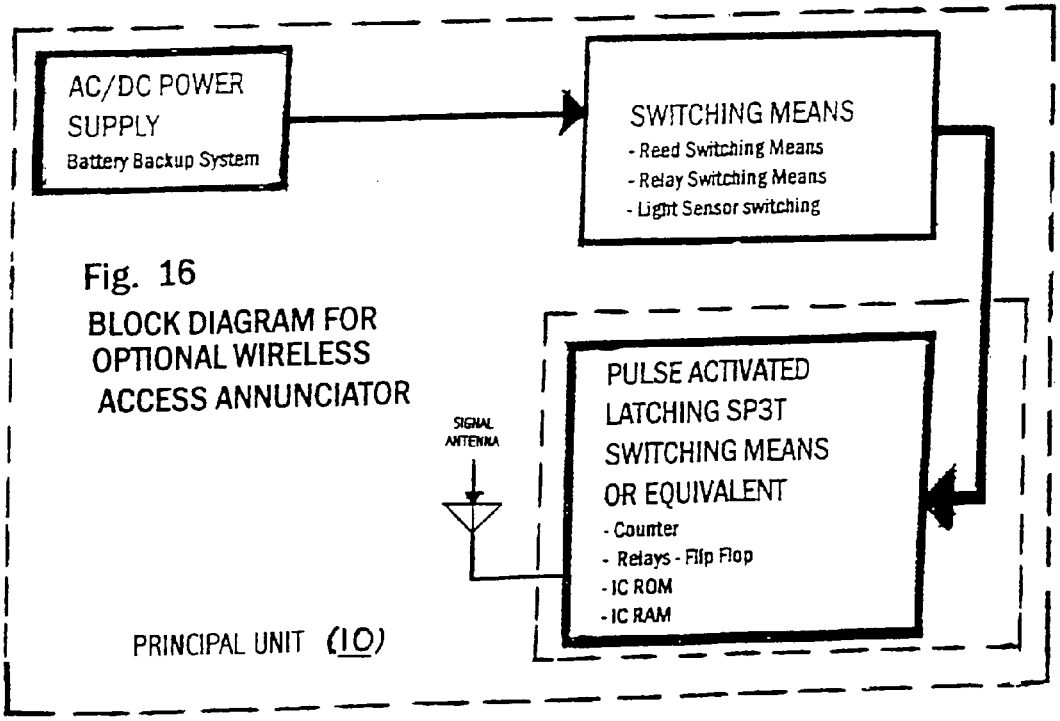
FIG. 16 is a block diagram of an optional, wireless Access Annunciator.

It is also to be noted that while the present device can be hard wired, it is also possible that various components can be wirelessly connected. For example, FIGS. 14, 15 and 16 provide schematic block diagrams of the aforementioned Hand Held Portable Device Reader (40) (FIG. 14), a Wireless Controller for aforementioned Principal Unit (10) (FIG. 15), and a Wireless Access Annunciator (10B) (FIG. 16). These units can be used as the entire system, or used in conjunction with hard wired components.

Typical Mounting and Installation Procedures

The Embodiment comprising aforementioned component parts herein, as specified within the specification, inclusive of varied housing combinations of said principal components, and said additional component parts herein will be inconspicuously located and secured by means of:

Surface mounting using an approved adhesive or equivalent.

Surface mounting by means of screws secured within (28) as per FIGS. 3, 4, 6, 7 and 13.

Receptacle insertion fit as per FIGS. 1, 2, 5 and 13.

Integrally formed and molded within desired surface having color, configuration, and texture similar to adjacent surrounds for inconspicuousness.

For application to aforementioned Portable Enclosures said Principal Unit (10) is preferably inconspicuously attached to, and installed upon the physical body of said portable enclosure having aforementioned access switch housed within container of said principal unit or remotely located to it so as to satisfy the uniqueness of each installation environment.

Obviously, the access annunciator can be adapted to receive signals from one source, or from multiple sources, such as, for example, a situation where there a two or more access points to a room, or the like.

Differences Between the Access Annunciator and the Prior Art:

The present inventive embodiment is not an area protection device.

It is an area intrusion informing device.

It is simple in structure.

It is immune to false alarms.

It has no panic button.

It has no entry/exit time delay.

It has an optional numerical display.

It has no master code, or sub-codes.

It is multiple zoned enabled.

It is substantially small in size.

The present inventive embodiment is a simple device to assemble, and comprises a minimal number of component parts in order to substantiate the purposeful use for which it is intended. Specifically that of an area intrusion informing device.

Thus, it is apparent that there has been provided, in accordance with the present invention, an access annunciator which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

The invention claimed is:

1. An access annunciator device for informing a user of unauthorized entry within a window, filing cabinet, desk drawer, closet, lunch pail, heavy duty field equipment, areas enclosed by automotive doors, automotive lids or automotive hoods, or within an enclosure closed by an access doors wherein said access annunciator device is surface mounted on said access door or mounted of an access door frame, or within an enclosure having an access opening covered by a lid, which access annunciator device comprises an access switch which access switch provides an access signal when said access switch is activated, an activation counter and counter memory means which counts the number of access signals received, an alert system which remains silent on a first and a second access signal, and which will first energize an alert signaling means on a sequential third access signal, and an alert signaling means for generating an alert signal when activated by said alert system.

2. A device as claimed in claim 1 wherein said counter memory means has a reset means.

3. A device as claimed in claim 1 wherein said alert signal is transmitted wirelessly to a remote alert display unit.

4. A device as claimed in claim 1 wherein said alert signal energizes an alert device.

5. A device as claimed in claim 4 wherein said alert device is an audible, visual, or vibratory signal.

6. A device as claimed in claim 1 wherein said access switch is a momentary access switch.

7. A device as claimed in claim 6 wherein said momentary access switch is a contact switch, a reed switch, a relay switch, or a light sensor switch.

8. A device as claimed in claim 1 wherein said alert system comprises a pulsed activated switching means.

9. A remote display unit for use with an access annunciator as claimed in claim 1 wherein said remote display unit is utilized to control said access annunciator and/or receive alert signals from said alert signaling means.

* * * * *